United States Patent [19]

Stroh

[11] 3,993,002

[45] Nov. 23, 1976

[54] SHELVING STRUCTURE

[76] Inventor: Alvin L. Stroh, 9409 Downey Ave., Downey, Calif. 90240

[22] Filed: Aug. 28, 1975

[21] Appl. No.: 608,527

[52] U.S. Cl. ..... 108/108; 108/102; 211/90; 211/153; 211/175; 248/241; 248/250

[51] Int. Cl.[2] ..... A47B 9/00

[58] Field of Search ..... 108/102, 108; 211/90, 211/175, 94, 94.5; 248/235, 241, 250, 274, 298

[56] References Cited

UNITED STATES PATENTS

| | | | |
|---|---|---|---|
| 2,031,718 | 2/1936 | Kress | 211/90 X |
| 3,355,134 | 11/1967 | Chesley | 108/108 X |
| 3,730,108 | 5/1973 | Stroh | 108/108 |

*Primary Examiner*—James C. Mitchell
*Attorney, Agent, or Firm*—John T. Matlago

[57] ABSTRACT

A merchandising system is disclosed which provides improved supporting brackets for mounting wire shelves on spaced apart structures secured to a supporting wall. The supporting brackets are provided with a pair of detachable clamps by which the brackets can be simply hingedly attached to the sides of a wire shelf formed with a back wall as well as the sides of a more conventional wire shelf formed without a back wall.

8 Claims, 11 Drawing Figures

SHELVING STRUCTURE

This invention relates to merchandising systems and more particularly to improved shelving structure therefor.

In shelf structure of the type which is in widespread use in retail stores for displaying merchandise, it is desirable to install shelving which may be several feet long. The wire shelves fabricated of wire may vary in their longitudinal width in fixed increments and may be positioned at any desired level. Thus, to accomodate such wire shelves, the supporting structures on which the wire shelves are mounted comprise horizontally extending vertically spaced hangbar members which are fastened directly to the supporting wall and vertically extending horizontally spaced apart upright members which are adjustably attached to the faces of the hangbar members.

Inasmuch as the wire shelves conventionally mounted on the upright members of such supporting structure do not have a back wall formed thereon, care is required that articles carried on these shelves do not fall into or get trapped in the gap left between the back edge of the wire shelf and the supporting wall. Thus there are times when it would be desirable to have some of the wire shelves provided on such wall supporting structure to be of the type formed with back walls for retaining and supporting articles being displayed on the shelves.

A wire shelf with a back wall which is admirably suited for this purpose is disclosed in U.S. Pat. No. 3,730,108 issued on May 1, 1973 to Alvin L. Stroh. In accordance with this patent, a wire shelf having a main outer frame formed with a back wall is provided with a pair of spaced reinforcing wire members having L shaped hook ends which extend outwardly from the sides of the outer main frame of the shelf. For supporting the wire shelf on a free standing portable supporting structure, special rectangularly shaped brackets are attached to the pair of spaced hook ends on the sides of the wire shelf by a pair of spaced integrally formed loop elements formed on the upper half portions or a similarly formed pair of spaced loop elements formed on the lower half portions of each of the brackets. By such a choice of attachment, the brackets provide for supporting the wire shelf while further serving either as an end retaining wall for the shelf or merely as an unobstructing end support for the shelf.

While such wire shelves formed with back walls would be highly desirable for mounting on the wall supporting structure previously described, the rectangularly shaped brackets provided with a choice of loop element attachments to the pair of hook ends on the sides of such wire shelves are not practical for the present merchandising system since they provide too much of an obstruction on the ends of the shelf and, further, interfere with the storage capacity of the next lower shelf. Furthermore, the mere adopting of the rectangularly shaped brackets disclosed in the previously referred to patent to the merchandising system of the present invention would be disadvantageous in that such brackets could not be attached on the transverse sides of the more conventional wire shelves without a back wall and it is inconvenient and costly to provide a differently cnstructed bracket for wire shelves with a back wall and wire shelves without a back wall. Thus it would be highly advantageous to provide generally triangular shaped brackets with detachable fastening means which can be interchangeably utilized to attach the brackets to either type of such wire shelves for use on the same wall supporting structure.

Accordingly, one of the objects of the present invention is to readily adapt a wire shelf simply constructed with a back wall for attachment to a wall supporting structure.

Another object of the present invention is to provide simply structure detachable clamps for positively hingedly attaching a supporting bracket to L shaped hook ends extending from the sides of a wire shelf provided with a back wall.

Another object of the present invention is to provide a simple detachable clamping structure on brackets by which the brackets can just as readily be attached to the transverse sides of the outer main frame of a wire shelf formed without a back wall as they can be attached to the L shaped hook ends of reinforcing wire members extending outwardly from the sides of the main outer frame of a wire shelf formed with a back wall.

With these and other objects in view, the invention consists of the construction, arrangement and combination of the various parts of the device whereby the objects contemplated are obtained as hereinafter set forth, pointed out in the appended claims and illustrated in the accompanying drawings.

Figure 1:
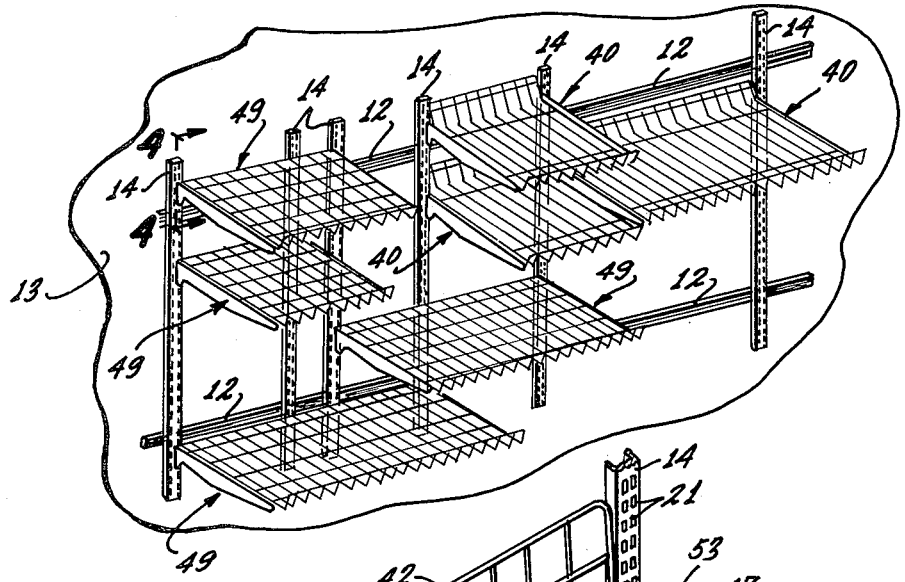
FIG. 1 is an overall view of a merchandising system using the shelving structure of the present invention.

Referring to FIG. 1 of the drawings, the improved shelf structure of the present invention includes a pair of horizontal hangbar members 12 secured to a supporting wall 13 in spaced apart relationship. A plurality of vertical upright members 14 are adjustably secured to the hangbar members 12 in spaced apart relationship.

Figure 2:
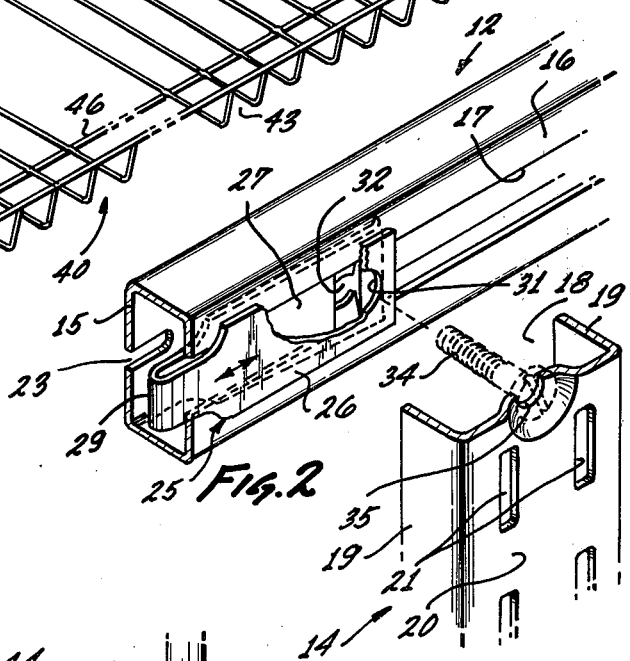
FIG. 2 shows the structure for adjustably attaching the upright members to the hangbar members.
Figure 4:
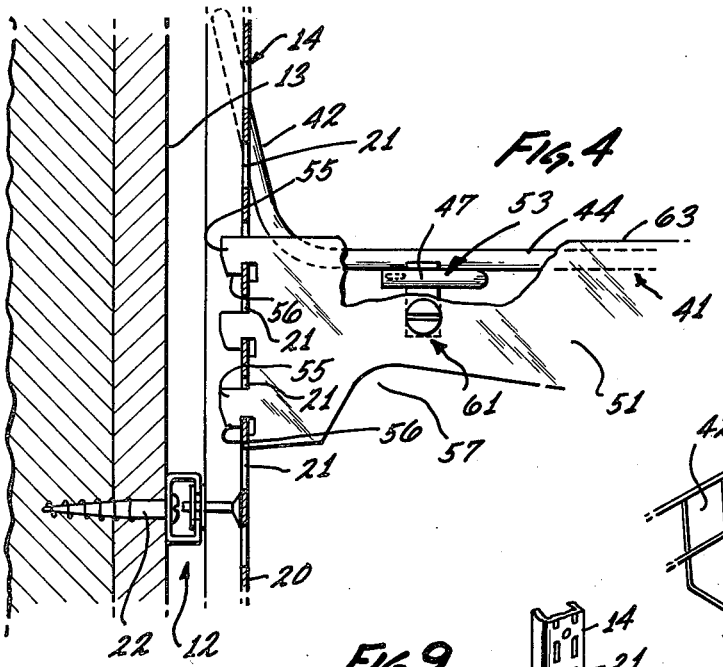
FIG. 4 is a sectional view taken long line 4—4 in FIG. 1 showing the lugs on the inner end of a shelf supporting bracket inserted in spaced openings provided on a upright member being held on a hangbar member fastened to the wall.

As shown in FIG. 2, each of the horizontal hangbar members 12 is a channel structure provided with a back 15 and a face 16. A continuous slot 17 is formed along the length of the face 16 of the hangbar member 12. Each of the upright members 14 is a channel structure provided with an open back 18, sides 19 and a face 20 having two columns of spaced openings 21 therealong. As shown in FIG. 4, the hangbar members 12 are securely fastened to the supporting wall 13 by screws 22 passing through openings 23 in the back 15 thereof. A clip 25 for holding an upright member 14 on a hangbar member 12 is formed by bending a rectangular length of spring steel back on itself. In use, the free ends of the front portion 26 and back portion 27 of the clip are pried apart and placed over the end of the face 16 of hangbar member 12 such that the side edges of the front and back portions of the clip can be positioned to bear on the side edges of the slot 17. The width of the bent end 29 of the clip 25 is narrowed down such that it is free to slideably move along the slot 17 for positioning on the hangbar member 12. A hole 31 is provided in the front porton 26 and an aligned threaded opening 32 is provided on the back portion 27 of the clip 25. A screw 34 passing through an opening 35 in upright member 14 extends through hole 31 on the front portion 26 of the clip, and then engages the threaded opening 32 on the rear portion 27 of the clip 25. Thus, after an upright member 14 and the clip 25 to which it is attached have been positioned properly along a hangbar member 12, upon tightening the screw 34, the rear portion 27 of the clip 25 is drawn toward the front portion 26 thereof, thus securing the upright member 14 in position on the hangbar member 12.

As shown in FIG. 1, two forms of wire shelves 40 and 49 are mounted on the wall supporting structure shown. The first form of wire shelf 40 (FIG. 3) includes a wire outer main frame 41 having its rear portion bent upwardly to provide a back wall 42. The second form of wire shelf 49 (FIG. 9) includes a wire outer main frame 65 formed with a back portion 48 thereof lying at the same level as the bottom of the shelf, i.e., without a back wall. The second form of wire shelf 49 is considered the more conventional type of shelf.

More particularly, the first form of wire shelf 40 includes an outer main frame 41 fabricated from relatively heavy gage wire. The straight peripheral sides of the main frame 41 define the transverse sides 44 of the flat bottom of the wire shelf, while an upwardly bent rear portion of the peripheral sides of the main frame 41 defines the back wall 42, and an upwardly bent front portion of the peripheral sides of main frame 41 defines the front wall 43. A plurality of regularly spaced, lighter gage wire elements 45 each conforming in shape to the straight transverse side 44 and the upwardly bent back and front walls 42 and 43 are provided along the length of the main frame 41. A pair of longitudinally extending spaced heavy gage reenforcing wire members 46 is provided along the bottom of the main frame 41. Each of the wire members 46 extends beyond the peripheral transverse sides 44 of the main outer frame 41 and its outer ends are directed inwardly at a right angle to form L shaped hook ends 47 on either side of the shelf 40. Note that the hook ends 47 extend rearwardly and parallel to the transverse sides 44 of the main outer frame 41.

As will be subsequently made clear, the outrigger structure on the peripheral transverse sides 44 of the shelf 40 simplifies the fabricating of the shelf in that the rear portions of the straight transverse sides 44 of the outer main frame 41 need be merely bent upwardly to form the back wall 42 which will fit between a pair of upright members 14, i.e., the rear portions of the transverse sides of the outer main frame do not have to be bent laterally inwardly so that the width of the back wall is less than the width of the bottom of the shelf.

Figure 3:
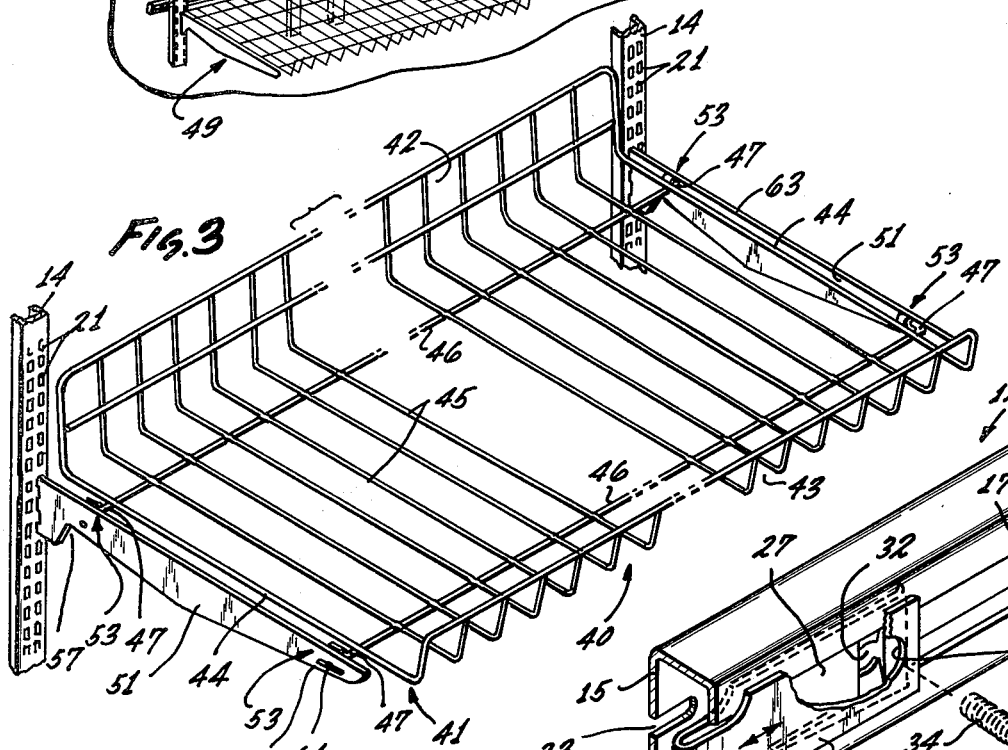
FIG. 3 is an enlarged view of a wire shelf with a back wall being supported on a pair of spaced upright members by use of the supporting brackets and clamping structures of the present invention.
Figure 5:
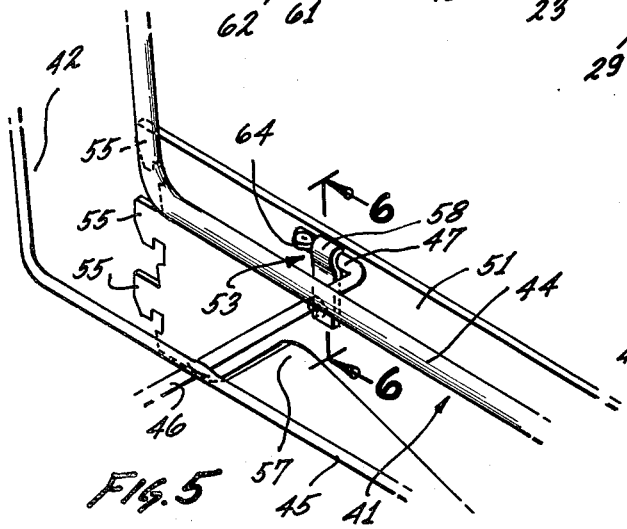
FIG. 5 is an enlarged view of an end portion of the shelf in FIG. 3 showing the bracket attached by its clamping structure to hook ends extending from the sides of the main outer frame thereof.

Next to be described is the bracket 51 with the pair of clamps 53 provided thereon for attaching the bracket 51 to the pair of hook ends 47 extending from the peripheral transverse sides of the shelf 40. Referring to FIGS. 3 and 5, the bracket 51 which is made of sheet metal may be considered generally triangular in shape in that its outer end is narrow and its inner end is wider so that three spaced lugs 55 can be formed thereon. Inasmuch as it is desirable to have the depths of the brackets 51 when mounted on the wall supporting structure minimized so that they wll not interfere with the viewing of the articles being displayed on the shelf 40 and the storage of articles on the next lower shelf, the rear bottom portions 57 of the brackets just in front of the lug or inner ends thereof can be cut away.

Figure 6:
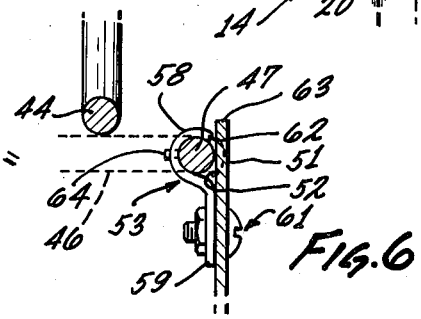
FIG. 6 is a sectional view taken along line6—6 in FIG. 5.

As best shown in FIGS. 5 and 6, each clamp 53 comprises a rectangular strip of metal having an upper curved portion 58 and a lower flat portion 59. The lower flat portion 59 is fastened onto the bracket 51 by a nut and bolt structure 61 which passes through openings on the bracket 51 and the flat portion 59. The opening provided on the outer end of the bracket 51 for the nut and bolt structure 61 is a slot 62 which provides for adjustment of the spacing of the clamps 53 to fit the spacing of the pair of hook ends 47, if necessary.

The curvature of the curved portion 58 of clamp 53 is such that it bears closely against the rounded surface of the wire forming the hook end 47. Thus, when the nut and bolt structures 61 of the clamps 53 are tightened, the transverse hook ends 47 extending from the sides of the shelf are held up closely against the face 52 of the bracket 51. It should now be clear that the hook ends 47 having a circular cross section form a hinge joint with the curved portions 58 of the clamps 53 about which the face 52 of the bracket 51 can be positively rotated.

As shown in FIG. 4, the three lugs 55 on the inner end of the bracket 51 are vertically spaced from each other such that the bracket 51 can be mounted on an upright member 14 at a desired position by inserting the three lugs 55 through three adjacent openings 21 in the upright 14 and pushing down on the bracket 51 such that the hook portions 56 on each of the lugs 55 engage the rear of the front wall, i.e., the face of the upright member 14. It should be noted that inasmuch as the upper edge 63 of the bracket 51 is actually slightly above the upper edge of the main frame 41, the portion of the bracket 51 which extends below outer frame 41 of the shelf 40 for the purpose of providing sufficient strength to support the shelf is minimized. Furthermore, the depth of the bracket 51 below the bottom of the shelf 40, which obstructs the side viewing of articles displayed on the shelves and the storage of articles on the next lower shelf is minimized.

Figure 8:
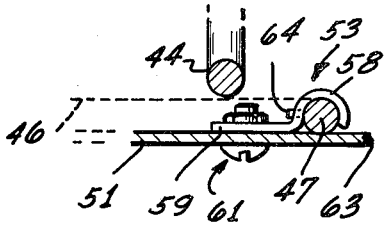
FIG. 8 is a sectional view taken along line 8—8 in FIG. 7.

The fastening of the pair of clamps 53 on the brackets 51 by the nut and bolt structure 61 which can be readily detached, i.e., loosened and tightened, to enable the curved portions 58 of the pair of clamps 53 to respectively fit closely on the pair of L shaped hook ends 47 of the wire shelves 40, is very desirable. The L shaped hook ends 47 on the wire shelf 40 have projections 64 on the inner sides thereof (FIG. 5). Thus, once the pair of clamps 53 are tightened by nut and bolt structures 61, the pair of hook ends 47 are retained on the bracket 51 by the projections 64, while permitting the bracket 51 to be rotated about the rounded surface of the hook ends 47 to either a vertical position (FIG. 3) or an inward horizontal position (FIGS. 7 and 8) flush with the bottom of the shelf 40 thus forming a compact unit for storage or shipping.

As shown in FIG. 3, the wire shelves 40 with the brackets 51 assembled on the hook ends 47 thereof are secured to a pair of accurately spaced upright members 14 by inserting the three lugs 55 on the inner ends of the respective brackets 51 in three adjacent spaced openings 21 provided on the upright members 14. It should be understood that although the standard widths of the shelves 40 as provided by different manufacturers may vary slightly, all the shelves as provided by one manufacturer will be of the same width. Thus, once the upright members 14 have been adjusted on the hangbar members 12 to a spacing for receiving a given standard width shelf 40 as provided by a given manufacturer, such shelves can be readily mounted on the supporting structure by inserting the three lugs 55 on the inner ends of the brackets 51 in three adjacent openings 21 of the upright members 14.

As clearly shown in FIGS. 3 and 4, an advantage of the extended hook ends 47 on the sides of the wire shelf 40 is that they enable the back wall 42 of the shelf 40, which is simply formed by bending up the rear portions of the straight transverse sides 44 of the main frame 41, to fit between the pair of upright members 14. It should be noted from FIG. 6 that when the clamp 53 is tightly attached to the bracket 51 by the nut and bolt structure 61, the curved portion 58 of the clamp 53 holds the hook end 47 of the shelf 40 against the face 52 of the bracket 51 at a level just below the upper edge 63 of the bracket 51. Thus, the clamps 53 must be formed of strips of heavy gage metal since they actually support the shelf 40.

Figure 7:
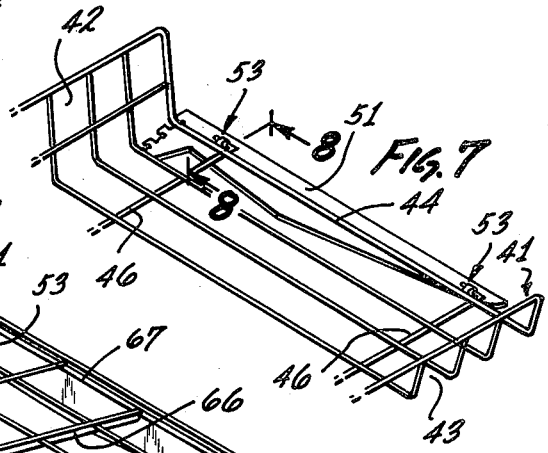
FIG. 7 is an enlarged view of an end portion of the shelf in FIG. 3 showing the bracket clamped on the hook ends thereof swung back so as to be flush beneath the bottom thereof.

It should now be clearly understood that the shelf outrigger structure afforded by the hook ends 47 extending from the sides of shelf 40 permits the mounting of the shelf 40 formed with a back wall 42, when needed, onto the wall supporting structure. It should be further evident that once the brackets 51 are assembled on the pair of hook ends 47 of the wire shelf 40, they can then be swung back against the bottom of the shelf 40, as shown in FIG. 7, to form a flat compact unit. Thus, the shelves 40 can be nested upon one another such that several with brackets already attached thereto by clamps 53 can be placed in a relatively small area.

Figure 9:
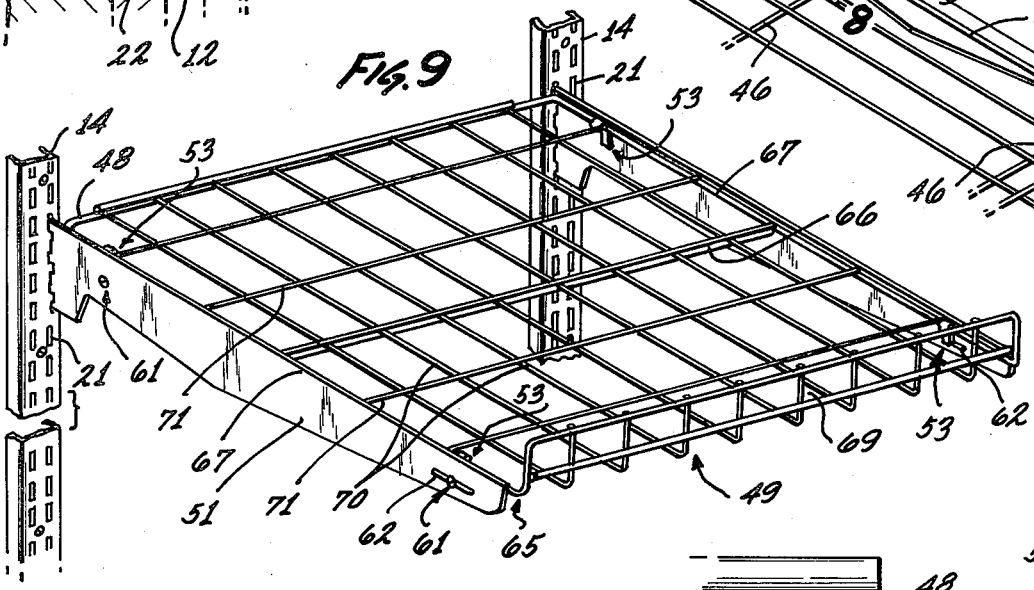
FIG. 9 is an enlarged view of a wire shelf without a back wall being supported on a pair of spaced upright members by use of the bracket and clamping structure of the present invention.
Figure 11:
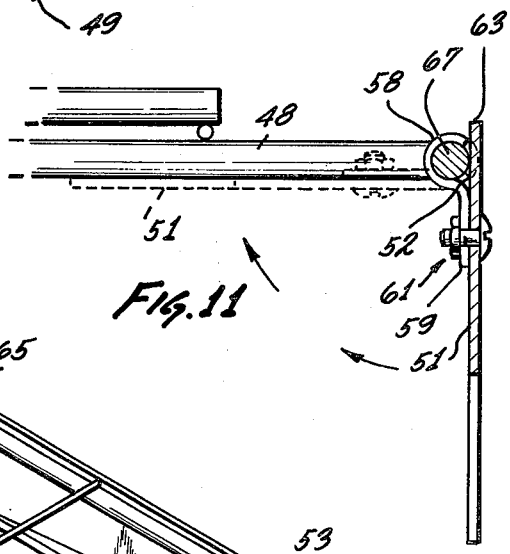
FIG. 11 is a sectional view taken along line 11—11 in FIG. 10.
Figure 10:
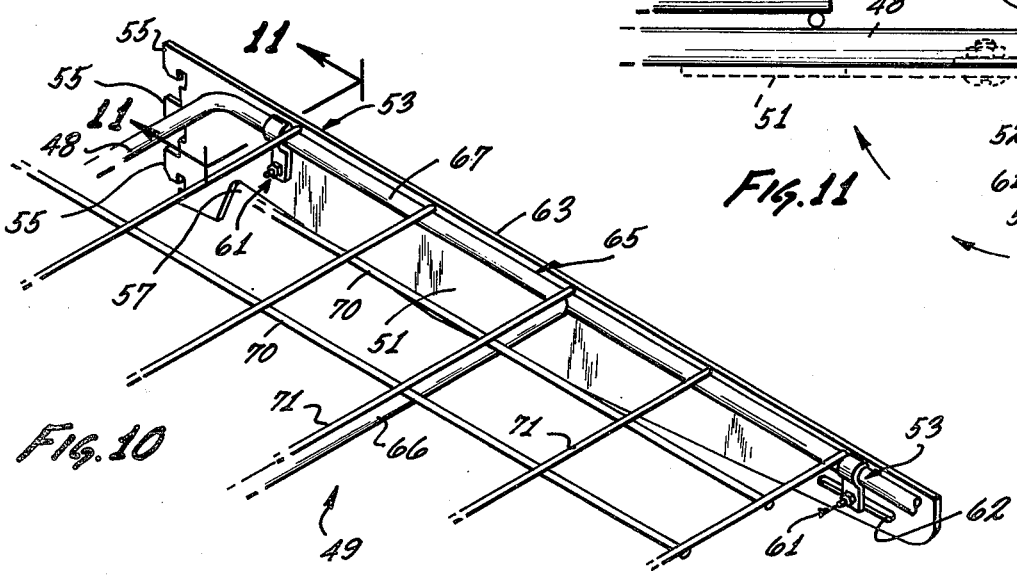
FIG. 10 is an enlarged view of an end portion of the shelf in FIG. 9 showing the bracket attached by its clamping structure to the side of the main outer frame thereof.

Next to be described in connection with FIGS. 9, 10 and 11 is the more conventional type of wire shelf 49 which is mounted on the wall supporting structure shown in FIG. 1 when there is no need to provide a shelf with a back wall. The wire shelf 49 comprises a generally rectangular outer main frame 65 fabricaed from relatively heavy gage wire. The peripheral transverse wire sides 67 of the outer main frame 65 define the flat bottom of the wire shelf, while the rear wire portion of the main frame 65, which remains at the same level as the transverse wire sides 67, defines the back 48 of the shelf, and an upwardly front portion of the main frame defines the front wall 69 of the shelf. A grillwork of lighter gage wire secured within the main frame 65 consists of a plurality of spaced wire elements 70 which extend in a direction substantially parallel to the transverse sides 67 of the main frame and a plurality of spaced wire elements 71 which extend normally to the transverse sides 67 of the main frame. A heavy gage wire reenforcing member 66 forming a part of the main frame 65 may extend adjacent the centrally disposed wire element 71 as shown in FIG. 10. The various wire elements 70, 71 of the grillwork may be secured together and to the main frame 65 by welding.

The wire shelf 49 uses the same supporting bracket 51 previously described to support shelf 40 in that it is attached by the pair of clamps 53 to the transverse wire sides 67 of the main frame which sides are parallel to the top edge 63 of the bracket 51. As before described, to assemble the brackets 51 on the sides of the shelf 49, the nut and bolt structures 61 holding the clamps 53 are loosened and the transverse wire sides 67 of the outer frame are placed into the curved portions 58 of the clamps 53. The tightening of the nut and bolt structures 61 then causes the curved portions 58 of the clamps 53 to bear closely against the transverse wire sides 67 causing the latter to be drawn up against the face 52 of the bracket 51 as the nut and bolt structure is tightened. As shown in FIG. 9, the slots 62 on the outer end portions of the brackets 51 permit the pair of clamps 53 to be spaced so as to bear up against the outer sides of the front and rear wire elements 71, thereby preventing any inward-outward movement of the shelf 49 relative to the bracket. As illustrated in FIG. 11, the bracket 51 is thus held such that it can be positively pivoted by its face 52 about the peripheral surface of the wire having a round cross section and forming the transverse side 67 of the outer frame 65 to assume either a vertical position for mounting on the upright members 14 or to assume a horizontal position, as shown by dashed lines in FIG. 11, whereby the bracket 51 is swung back flush against the bottom of the shelf thus forming a compact unit for storage or shipping.

It should now be clearly understood that the manufacturer of the wire shelves 40 and 49 may mount the brackets 51 on the end members of the shelves, i.e., on the hook ends 47 of shelf 40 or on the transverse sides 67 of the outer main frame 65 of shelf 49. Then, by rotating the brackets 51 back against the bottoms of the shelves 40 and 49 several of the shelves may be stacked together and shipped. The shelves 40 and 49 when received in a retain store are thus provided with the brackets 51 already attached to the sides thereof. Thus, when either form of the shelf 40 or 49 is taken out of the shipping carton the supporting brackets 51 thereon need be merely swung downwardly to a vertical position such that the lugs 55 on the inner end thereof can be fitted into the vertical openings 21 on the pair of upright member 14 previously secured in position on the hangbar members 12 to accomodate such a shelf of the desired standard width. If the upright members 14 should need adjustment to accomodate the standard width shelves, this need only be done once and the rest of the standard width shelves of the same form will fit thereon since they all came from the same manufacturer.

In view of the above, it should now be clearly understood that an important advantage of the shelf supporting bracket 51 provided with a pair of readily detachable clamps 53, as shown and described herein, is that the same bracket 51 is able to just as readily be attached on the hook ends 47 extending from the sides of the outer frame of a wire shelf 40 formed with a rear wall 42 as it can be attached to the transverse sides 67 of the outer frame of a more conventional backless wire shelf 49. Thus, such a construction of the bracket 51 eliminates the need for providing different forms of construction for the two types of shelves.

From the description it will be apparent that there is thus provided a device of the character described and possessing the particular features of advantage before enumerated as desirable but which obviously is susceptible of modification in its form, proportion, detail construction and arrangement of parts without departing from the principle involved or sacrificing any of its advantages.

While in order to comply with the statute, the invention has been described in language more or less specific as to structural features, it is to be understood that the invention is not limited to the specific features shown but that the means and construction herein disclosed comprise the preferred forms of several modes of putting the invention into effect and the invention is therefore claimed in any of its forms or modifications within the legitimate and valid scope of the appended claims.

What is claimed is:

1. A shelf structure comprising:

a pair of horizontally extending hangbar members fixedly securable to a supporting wall in a spaced relationship, a pair of upright members, each said upright members having a front wall with vertically spaced apart openings, means including elements slideably engaging said hangbar members for adjustably securing said pair of upright members on said pair of hangbar members in spaced relationship, a plurality of wire shelves, each wire shelf having side elements, a pair of supporting brackets for each of said wire shelves, each said bracket having an inner end with lugs means thereon and a narrower outer end, and a pair of clamps for each said bracket, each said clamps having a flat lower portion and a curved upper portion and including threaded fastening means for fastening said flat portion to the bracket, said curved upper portions of said clamps being disposed below the upper edges of said brackets and hingedly holding the side elements of a wire shelf against the faces of said brackets when said fastening means are tightened, whereby each wire shelf can be detachably secured to the upright members at a selected vertical level by pivoting the brackets on the side elements thereof from a position flush against the underside of said shelf to a vertical position and inserting the lug means on the inner ends of said brackets into selected openings on the front walls of said upright members.

2. The invention in accordance with claim 1 wherein said curved upper portions of said clamps are shaped to hingedly closely engage about the surface of the side elements of said wire shelf and thereby hold said side elements against the faces of said brackets when said fastening means are tightened.

3. The invention in accordance with claim 1 wherein at least one of said wire shelves is formed with a generally upwardly directed back wall and at least one of said wire shelves is formed without such a back wall.

4. The invention in accordance with claim 1 wherein each of said wire shelves includes a main outer frame formed with a generally upwardly bent rear portion which defines a back wall for said shelf, and wherein the side elements of each of said shelves comprise a pair of L shaped hook ends which extend beyond the sides of said main outer frame and which are received in the openings provided by the curved upper portions of the clamps.

5. The invention in accordance with claim 4 including projections on the inner sides of said hook ends.

6. The invention in accordance with claim 1 wherein each of said wire shelves includes a main outer frame formed without a back wall and the side elements of each of said wire shelves comprise the transverse sides of the main outer frame.

7. A shelving structure for mounting on a supporting structure including a pair of horizontally extending hangbar members fixedly securable to a supporting wall in spaced relationship, a pair of upright members each having a front wall with vertically spaced apart openings, and slideable attaching means for adjustably securing said pair of upright members to said pair of hangbar members in spaced relationship, the improved shelving structure comprising a wire shelf having an outer main frame formed with straight transverse sides and with a generally upwardly bent rear backwall portion, the respective sides of said back wall lying in the same vertical plane as the respective transverse sides of said outer main frame, a pair of spaced L shaped hook ends extending from the transverse sides of said outer main frame, said hook ends having a round peripheral surface, a bracket for each transverse side of said wire shelf, each said bracket having an inner end with three spaced lugs thereon and having a narrower outer end, a pair of clamps fastened to the face of each of said brackets in spaced relationship corresponding to the spaced relationship of the pair of hook ends extending from the transverse sides of said outer main frame, each said clamp formed of a rectangular strip having a curved upper portion and a flat lower portion, a nut and bolt structure for fastening the flat lower portion of each clamp to the face of said bracket, the curved upper portions of said pair of clamps being so disposed as to respectively hold said pair of hook ends against the face of said bracket, and said brackets and the upper curved portions of said clamps being pivotable about the round peripheral surfaces of said hook ends whereby the brackets can be disposed in a position flush against the underside of the wire shelf and can be pivoted to a vertical position for the mounting of the three lugs on the inner end thereof on three selected adjacent vertically spaced openings on said upright members.

8. A shelving structure for mounting on a supporting structure including hangbar members fixedly securable to a supporting wall in spaced relationship, a pair of upright members each having a front wall with vertically spaced apart openings, and slideable attaching means for adjustably securing said pair of upright members to said pair of hangbar members in spaced relationship, the improved shelving structure comprising a wire shelf including an outer main wire frame formed with straight transverse sides, a bracket for each transverse side of said wire shelf, each said bracket having an inner end with three spaced lugs and having a narrower outer end, a pair of clamps fastened in spaced relationship to the face of each said brackets, each said clamp formed of a rectangular strip having a curved upper portion and a flat lower portion, a nut and bolt structure for fastening the flat lower portion of each clamp to the face of said bracket, the curved upper portions of said pair of clamps being shaped to engage closely about the peripheral surface of the transverse side of said shelf and hold said transverse side against the face of said bracket whereby said bracket and the upper curved portions of said clamps are pivotable about the peripheral surface of said transverse side, and whereby the brackets can be disposed in a position flush against the underside of the wire shelf and can be pivoted to a vertical position for the mounting of the three lugs on the inner end thereof on three selected adjacent vertically spaced openings on said upright members.

* * * * *